United States Patent [19]

Anthony et al.

[11] 4,168,148

[45] Sep. 18, 1979

[54] COAL DESULFURIZATION

[75] Inventors: Donald B. Anthony, Aurora; Allan V. Marse, Independence, both of Ohio

[73] Assignee: The Standard Oil Company (Ohio), Cleveland, Ohio

[21] Appl. No.: 891,961

[22] Filed: Mar. 31, 1978

[51] Int. Cl.[2] ..... C10L 9/10; C10B 57/00

[52] U.S. Cl. ..... 44/1 SR; 201/17

[58] Field of Search ..... 44/1 R; 75/6; 201/17

[56] References Cited

U.S. PATENT DOCUMENTS

| | | | |
|---|---|---|---|
| 3,472,622 | 10/1969 | Ridley | 201/17 X |
| 4,018,572 | 4/1977 | Swanson | 44/1 R |
| 4,071,328 | 1/1978 | Sinke | 44/1 R |

*Primary Examiner*—Carl Dees

*Attorney, Agent, or Firm*—John E. Miller; Herbert D. Knudsen; Larry W. Evans

[57] ABSTRACT

The sulfur content of coal can be significantly reduced by leaching the coal with an aqueous solution of sodium sulfite.

10 Claims, No Drawings

COAL DESULFURIZATION

BACKGROUND OF THE INVENTION

The present invention relates to a novel chemical leaching process for significantly reducing the sulfur content of coal.

Processes for removing sulfur from coal by chemical leaching operations are well known. Examples of such processes are TRW's Meyer's process and Battelle's Hydrothermal process.

Although each of these processes is capable of removing significant quantities of sulfur from coal, they each suffer significant disadvantages. For example, TRW's Meyer's process is effective only in removing inorganic sulfur from coal. Moreover, the Battelle process is disadvantageous because high pressures and temperatures are required.

Accordingly, it is an object of the present invention to provide a novel process for removing sulfur from coal which is effective in removing both organic and inorganic sulfur and which can be carried out at comparatively low temperatures and pressures.

SUMMARY OF THE INVENTION

This and other objects are accomplished by the present invention which is based on the discovery that significant amounts of both organic and inorganic sulfur contained in coal can be removed from the coal by chemically leaching the coal with an aqueous solution of sodium sulfite.

Thus, the present invention provides a novel process for removing sulfur from coal comprising contacting the coal with an aqueous sodium sulfite solution.

DETAILED DESCRIPTION

In accordance with the present invention, both organic and inorganic sulfur contained in coal can be removed therefrom by chemically leaching the coal with an aqueous solution of sodium sulfite.

The inventive process is applicable to all types of coal. In this regard, it is well known that the chemical composition of coals obtained from different locations can vary widely. The inventive process can be practiced on all types of coal, although the amount of desulfurization attainable varies with the particular coal being processed.

The coal to be treated by the inventive process can be of any size although it should be in particulate form since this increases the contact of the aqueous sulfite solution with the coal mass. Preferably, the particulate coal should have a particle size no larger than about ⅛ inch since the efficiency of the process decreases at higher particle sizes. Below this value, however, it has been found that there is no particular criticality in the particle size of the coal, essentially the same results being obtained regardless of particle size. It is desirable, however, to avoid using coal of too fine a particle size, since as well known, physical separation of extremely fine particles from an aqueous liquid can be difficult.

The leachant used to process coal in accordance with the present invention is an aqueous solution of sodium sulfite. The concentration of sodium sulfite in the aqueous solution is not particularly critical and can vary over wide limits. Normally, the concentration of sodium sulfite should be above about 0.1 normal in order that the sulfur removal capabilities of the leachant solution are significant. Any sodium sulfite concentration from this value up to the saturation value can be employed with facility, a concentration of about 1 normal being preferred.

The leachant solution of course can contain other dissolved or suspended matter which does not interfere with the inventive sulfur removal process.

The amount of leachant contacted with a given amount of coal is also not critical. As a practical matter, the coal/leachant ratio should be at least 1/20 in order for the process to be economic. Furthermore, when the coal/leachant ratio exceeds 1.5/1, the mixture becomes too viscous. Therefore, it is preferable to operate with a coal/leachant ratio between about 1/20 to 1.5/1. Preferably the coal/leachant ratio is about 1/5.

The temperature at which the coal is contacted with the leachant can also vary widely. The process should be conducted at, near or above the boiling point of the leachant. Thus, it is preferred to carry out the process at a temperature of about 80°–400° C., most preferably 100°–150° C. Preferably, the process is carried out under reflux conditions, i.e. vapors driven off the leachant through boiling are condensed and returned to the leachant. The pressure at which the process is carried out can vary widely. Atmospheric, subatmospheric or superatmospheric pressures can be used.

The contact time of the leachant with the coal necessary for significant sulfur removal varies depending on a number of factors such as the concentration of sodium sulfite in the leachant, temperature, and the particular coal being processed. Normally, contact times on the order of ½ hours to 24 hours are employed.

When the leaching procedure is finished, the processed coal and the leachant are separated from one another. This can be accomplished by any convenient technique such as, for example, filtering.

The treated particulate coal recovered in this manner can be used as is. However, it has been found in accordance with a further feature of the present invention that additional amounts of sulfur can be removed from the coal by washing the coal with an acid wash. Although not wishing to be bound to any theory, applicants believe that as a result of the inventive leaching procedure, some of the sulfur in the coal is transformed into iron sulfide which as known is essentially insoluble in neutral and slightly basic solutions. Since the aqueous sodium sulfite leachant is slightly basic, the iron sulfide remains in the coal particles when they are separated from the leachant. By washing the coal particles with an acidic aqueous solution, however, the iron sulfide is caused to dissolve therein and hence be removed from the coal.

In carrying out the acid wash, any acid can be used, although hydrochloric acid is preferred. Also, it is preferred to avoid using sulfuric acid since it will introduce sulfur back into the coal and nitric acid since it will partially oxidize the coal. The concentration of acid in the aqueous acidic wash solution is not critical, concentrations ranging from 1.0 to 6.0 normal being preferred as most convenient. Also, it is desirable to water wash the coal after the acid wash to remove acid anions which may become entrained therein.

The spent leachant recovered from the processing operation can be discharged to waste if desired. It is possible, however, to at least partially regenerate the spent leachant for reuse. In this regard, one of the compounds present in significant amount in the spent leachant is sodium thiosulfite ($Na_2S_2O_3$). Various techniques are available for converting this compound to sodium sulfite, and these techniques can be easily employed on the spent leachant to recover a significant amount of sodium sulfite.

In a preferred embodiment of the present invention, a suitable amount of a caustic material is included in the leachant solution. In accordance with the present invention, it has been found that the presence of a caustic material in the leachant will significantly improve the amount of sulfur removal caused by the leachant solution.

Any base can be used as the caustic material for addition to the leachant solution. For example, sodium hydroxide, potassium hydroxide, ammonium hydroxide and various well known organic bases can be employed. Sodium hydroxide is preferred since the sodium ion is already present in the leachant solution.

The amount of caustic to be included in the leachant is also not critical. However, below about 1 normal no significant effect of the caustic will be realized. Therefore, the concentration of the caustic should be between about 1 normal and the saturated value. Above about 6 or 7 normal, there is no additional economic benefit for adding more caustic, and hence the concentration of caustic is preferably between about 1 and 7 normal, most preferably about 5 normal.

In a particularly preferred embodiment of the invention, the inventive process as discussed above is followed by a conventional float-sink operation. In this regard, it is a common commercial practice to process raw coal before it is sold to remove some of the ash content thereof. This is normally done by a density separation technique wherein ground raw coal is formed into a slurry of an appropriate liquid and agitated. This causes heavier inorganics in the coal, i.e. ash, to be separated from the remainder of the coal and fall to the bottom of the composition and the remainder of the coal to float to the top. Choice of the density of the liquid determines how much ash is separated out from the remainder of the coal. Although many different liquids can be used such as, for example, carbon tetrachloride, it is conventional in commercial operations to employ water. The "apparent density" of the water can be varied either by charging air into the bottom of the composition or by conducting the procedure in an apparatus which the water continuously flows upwards in the treating vessel.

In accordance with the present invention, it has been found that inventive treatment process in addition to removing sulfur from the coal will cause additional loosening of the inorganic matrix of the coal in much the same way as a Group I or II metal salt loosens the inorganic matrix in the invention of commonly assigned application (attorney docket 5080). Thus, when coal treated to the inventive procedure is subjected to float-sinking, more ash than would otherwise be possible under a given set of conditions is removed from the coal. This, of course, causes the coal product produced by this procedure to have a higher heat value than the raw coal charged.

In order to more thoroughly illustrate the present invention, the following examples are presented.

EXAMPLE 1

50 grams of a Pittsburgh seam coal from Ireland Mine, West Virginia, and containing 5.27 percent sulfur (2.05% pyritic/0.35 sulfate/2.87% organic) was ground to 40×60 mesh. The particulate coal so obtained was admixed with 250 cc of a saturated sodium sulfite aqueous solution. The composition so obtained was heated to boiling under reflux at atmospheric pressure. After 24 hours, the heating was stopped and the coal was recovered by filtration. The particulate coal was then washed with water and then treated with a boiling 10% aqueous solution of HCl for ½ hour. Product coal was analyzed and found to contain 3.31% sulfur (1.12 pyritic/0.03 sulfate/2.16 organic) which represents a 37% reduction in the sulfur content. Moreover, the ash content of the coal was reduced from 10.6% to 6.11%.

EXAMPLE 2

Example 1 was repeated except that the sodium sulfite solution further contained sodium hydroxide, the sodium hydroxide concentration being 5N. The product coal contained 1.11% sulfur (0.42 pyritic/0.03 sulfate/0.6 organics), which represents a 79% reduction in the sulfur content. The ash content of the product coal was 3.9%.

EXAMPLES 3 to 11

The process of Example 2 was repeated using a number of different coals. The results obtained are set forth in the following Table I.

TABLE I

| | Coal Type | | | Sulfur Content in Coal | | | Percent Sulfur Removed | | | Heating Value BTU/# | |
|---|---|---|---|---|---|---|---|---|---|---|---|
| Example | Seam | Mine | State | Total | Pyrite | Organic | Total | Pyrite | Organic | Coal | Product |
| 3 | Pittsburgh #8 | Ireland | W. Va. | 4.26 | 1.67 | 2.11 | 76 | 78 | 71 | 12,975 | 12,328 |
| 4 | Indiana #5 | Old Ben #1 | Ind. | 4.41 | 1.93 | 2.24 | 49 | 82 | 19 | 12,308 | 12,407 |
| 5 | Illinois #6 | Old Ben #21 | Ill. | 1.11 | 0.57 | 0.49 | 11 | 37 | 0 | 13,602 | 13,894 |
| 6 | " | Old Ben #24 | " | 2.41 | 0.81 | 1.57 | 7 | 28 | 0 | 13,240 | 13,677 |
| 7 | " | Old Ben #26 | " | 2.35 | 1.00 | 1.28 | 15 | 52 | 0 | 12,028 | 13,585 |
| 8 | Pittsburgh #8 | Ireland | W. Va. | 5.69 | 3.46 | 2.15 | 51 | 71 | 19 | 12,979 | 13,244 |
| 9 | Ohio #5 | Unknown | Ohio | 2.90 | 1.44 | 1.42 | 14 | 31 | 0 | 13,151 | 13,025 |
| 10 | Ohio #8 | " | Ohio | 2.74 | 1.32 | 1.41 | 12 | 21 | 4 | 13,853 | 13,011 |
| 11 | Pittsburgh #8 | Ireland | W. Va. | 2.26 | — | — | 20 | — | — | — | — |

From the foregoing it can be seen that the inventive coal desulfurization technique is applicable to a wide variety of different coals. In addition, it can be seen that the inventive process is very simple and straightforward to carry out and yet is still effective for removing both organic and inorganic sulfur from many coals. Further, as will be noted by comparing the heat values of the raw coal and the coal product of the inventive process, the inventive process serves to increase the heat value of the coal processed. Thus, the inventive process is of further advantage since it produces a higher heat content coal.

Although only a few embodiments of the present invention have been discussed above, it should be appreciated that many modifications can be made without departing from the spirit and scope of the invention. All such modifications are intended to be included within the scope of the present invention which is to be limited only by the following claims.

We claim:

1. A process for removing sulfur from coal comprising contacting the coal with an aqueous sodium sulfite solution.

2. The process of claim 1 wherein said aqueous sodium sulfite is heated to reflux during contact with said coal.

3. The process of claim 2 wherein said coal is particulate in form, substantially all of said coal having a particle size of no large than ⅛ inch.

4. The process of claim 3 wherein said aqueous sodium sulfite solution contains a base.

5. The process of claim 4 wherein said base is sodium hydroxide.

6. The process of claim 5 wherein said aqueous sodium sulfite solution is at least 0.1 normal in sodium sulfite.

7. The process of claim 6 wherein said aqueous sodium sulfite solution is at least 1 normal in sodium hydroxide.

8. The process of claim 7 further comprising separating said particulate coal from said aqueous sodium sulfite solution and thereafter washing said particulate coal with an aqueous acidic solution.

9. The process of claim 1 wherein said aqueous sodium sulfite solution contains a base.

10. The process of claim 9 further comprising separating said particulate coal from said aqueous sodium sulfite solution and thereafter washing said particulate coal with an aqueous acidic solution.

* * * * *